United States Patent [19]

Hruda

[11] 4,401,869

[45] Aug. 30, 1983

[54] HERMETICALLY SEALED ELECTRICAL SWITCH WITH PRESSURE REGULATING GETTER MEANS

[75] Inventor: Robert M. Hruda, Horseheads, N.Y.

[73] Assignee: Westinghouse Electric Corp., Pittsburgh, Pa.

[21] Appl. No.: 308,208

[22] Filed: Oct. 5, 1981

[51] Int. Cl.[3] ..... H01H 33/66

[52] U.S. Cl. ..... 200/144 B; 313/552

[58] Field of Search ..... 200/144 B; 313/174

[56] References Cited

U.S. PATENT DOCUMENTS 3,328,545 6/1967 Holliday ..... 200/144 B
4,260,934 4/1981 Kuus et al. ..... 313/174

FOREIGN PATENT DOCUMENTS 2002685 3/1971 Fed. Rep. of Germany ... 200/144 B
1402231 5/1965 France ..... 200/144 B

*Primary Examiner*—Robert S. Macon
*Attorney, Agent, or Firm*—W. G. Sutcliff

[57] ABSTRACT

A hermetically sealed, partially evacuated switch is maintained at a non-oxidizing residual pressure of from about $10^{-1}$ to $10^{2}$ Torr by inclusion of selected hydrogen gettering metal hydride within the sealed switch envelope. The metal hydride is selected with a hydrogen equilibrium pressure at the switch operating temperature such that the pressure within the switch envelope is maintained in the desired range.

4 Claims, 1 Drawing Figure

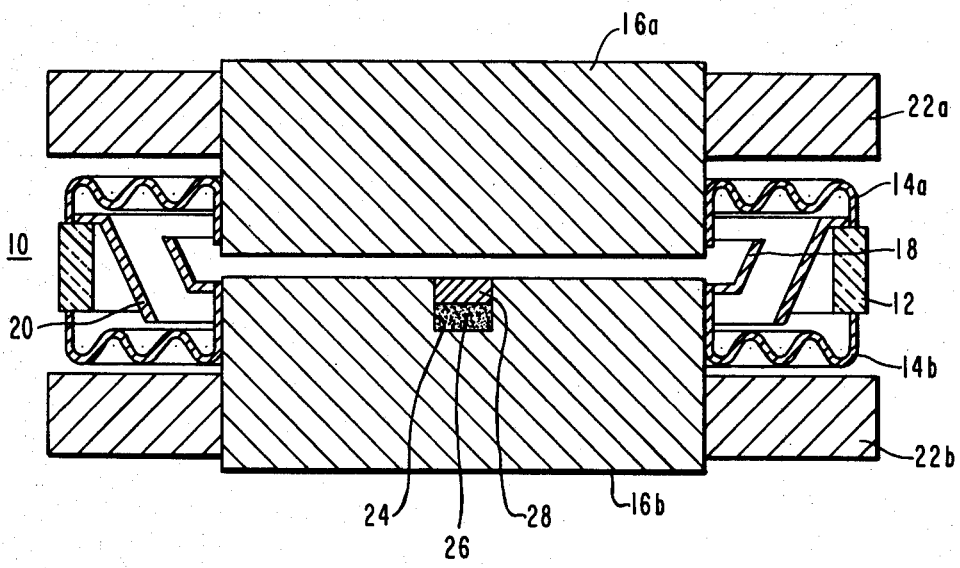
16a
22a
14a
10
18
12
20
14b
22b
24
26
28
16b

HERMETICALLY SEALED ELECTRICAL SWITCH WITH PRESSURE REGULATING GETTER MEANS

BACKGROUND OF THE INVENTION

The present invention relates to hermetically sealed electric switch modules, and more particularly to controlling the operating pressure within the switch module to minimize contact damage and erosion during separation of the contacts.

The electrical switch modules of the present invention include a.c. switch contactors or circuit breakers which operate at moderate power levels, and low d.c. voltage shunt bypass switches used in conjunction with electrochemical cells such as chlorine cells. Such a switch module is described in U.S. Pat. No. 4,216,361, which describes an evacuated switch.

It has been suggested that contact erosion of such arc contacts can be minimized by maintaining a predetermined pressure of about $10^{-1}$ to $10^{2}$ Torr within the hermetically sealed switch module, in copending application Ser. No. 206,502, filed Nov. 13, 1980, owned by the assignee of the present invention.

It has been the practice to use copper electrodes or contacts in such switches and a non-oxidizing fill gas such as hydrogen, or hydrogen-inert gas mixture. It is difficult to maintain the original fill gas pressure during operating life due to the gas clean up tendency of the interrupted arc which may be several thousand amperes, as well as diffusion of hydrogen through switch envelope walls.

For a switch used as a d.c. electrochemical cell shunt, the continuous current through the closed contacts will produce a switch operating temperature of about 90°-100° C., which affects the fill gas equilibrium pressure. It is desirable to be able to manufacture the switch module with an internal fill gas pressure within the desired operating pressure range and to maintain this desired fill gas pressure during a variety of operating conditions and over an extended operating lifetime.

In general, prior art vacuum switches are highly evacuated with the pressure beng less than $10^{-4}$ Torr, and hydrogen getters which maintain such high vacuum condition have been incorporated into such switches.

SUMMARY OF THE INVENTION

An improved hermetically sealed electrical switch module is provided with a reduced pressure non-oxidizing fill gas atmosphere of from about $10^{31\ 1}$ to $10^{2}$ Torr, and the fill gas is preferably hydrogen. A predetermined amount of selected hydrogen gettering metal hydride is provided within the hermetically sealed switch module. The metal hydride is selected with a hydrogen equilibrium pressure characteristic at the switch operating temperature such that the hydrogen fill gas pressure is maintained in the desired pressure range.

BRIEF DESCRIPTION OF THE DRAWING

The sole FIGURE is an elevational view in cross section of an electrical switch module of the present invention.

DESCRIPTION OF THE PREFERRED EMBODIMENT

The present invention can be best understood by reference to the embodiment seen in FIG. 1. In FIG. 1, the electrical switch module 10 has the basic structure of the device described in U.S. Pat. No. 4,216,361, modified as will be described hereafter. The switch module 10 comprises an annular insulating body portion 12, with annular, flexible, corrugated diaphragm members 14*a*, 14*b* extending transversely from the body portion 12 to cylindrical conductive contacts 16*a*, 16*b*. A hermetic seal is formed between the inner and outer extension of the diaphragm members 14*a*, 14*b* and the body portion 12, and between the contacts 16*a*, 16*b* and the respective diaphragm members 14*a*, 14*b*. An enclosed hermetically sealed switch volume is thus defined. A pair of spaced apart, angled annular arc shield means, inner arc shield 18 and outer arc shield 20, are disposed within the switch volume about the contacts 16*a*, 16*b* to intercept hot eroded material from the contacts during arc interruption on switch opening. The switch contacts 16*a*, 16*b* are in the spaced apart open contact position in FIG. 1. A pair of planar conductive mounting plates 22*a*, 22*b* are connected to the cylindrical contacts 16*a*, 16*b* outside the switch volume to facilitate connection of the switch contacts to electrical terminals or bus conductors of the system to which the switch is connected.

A non-oxidizing fill gas, preferably hydrogen, is provided in the switch volume at a pressure of about $10^{-1}$ to $10^{2}$ Torr, to minimize erosion of the preferably copper contacts 16*a*, 16*b*.

A generally cylindrical chamber 24 is formed in at least one of the contacs 16*b* extending from the contact surface and communicating with the switch volume. A predetermined amount of selected hydrogen gettering metal hydride 26 is disposed within the chamber 24. Preferably a porous refractory metal plug 28 is fitted within the chamber 24 to retain the metal hydride, which may be in powdered form within the chamber 24. The metal hydride is preferably uranium hydride. It has been found that to maintain the pressure within the switch volume in the desired range, the ratio of metal hydride to switch module volume should be about 2 milligrams per milliliter.

Uranium hydride is a specific hydrogen gettering material that exhibits an equilibrium pressure at the typical switch operating temperature of about 100° C., that is such as to provide the desired switch pressure of from about $10^{-1}$ to $10^{2}$ Torr. The uranium hydride will absorb any excess hydrogen liberated during arcing that takes place upon switch opening, and will also replace hydrogen lost through arc pumping or diffusion through the switch envelope walls.

I claim:

1. In an electrical switch module which is hermetically sealed and comprises an annular insulating envelope portion, annular flexible corrugated diaphragm members extending transversely inwardly from the annular insulating envelope portion to cylindrical conductive contact members, with a reduced pressure non-oxidizing fill gas atmosphere of from about $10^{-1}$ to $10^{2}$ Torr provided within the hermetically sealed switch module, the improvement wherein the fill gas is hydrogen and a predetermined amount of selected hydrogen gettering metal hydride is disposed within the hermetically sealed switch module, which metal hydride is selected with a hydrogen equilibrium pressure characteristic at the switch operating temperature such that the hydrogen fill gas pressure is maintained in the desired pressure range.

2. The electrical switch module set forth in claim 1, wherein a generally cylindrical chamber is provided in at least one of the contact members extending from the inwardly extending contact surface into the contact member, and the selected hydrogen gettering metal hydride is disposed within this cylindrical chamber formed in the contact.

3. The electrical switch module set forth in claim 2, wherein the selected metal hydride is uranium hydride and the ratio of hydride to switch module volume is about 2 milligrams per milliliter.

4. The electrical switch module set forth in claim 2, wherein the metal hydride is in powdered form, and a porous refractory metal plug is provided within the contact surface end of the cylindrical chamber.

* * * * *